US012109477B2

(12) United States Patent
Baker et al.

(10) Patent No.: US 12,109,477 B2
(45) Date of Patent: Oct. 8, 2024

(54) GUARD ASSEMBLY FOR EXERCISE MACHINE

(71) Applicant: Peloton Interactive, Inc., New York, NY (US)

(72) Inventors: Matthew Baker, San Diego, CA (US); Azhar Meyer, New York, NY (US); Kevin Danford, West Orange, NJ (US)

(73) Assignee: Peloton Interactive, Inc., New York, NY (US)

( * ) Notice: Subject to any disclaimer, the term of this patent is extended or adjusted under 35 U.S.C. 154(b) by 216 days.

(21) Appl. No.: 17/939,877

(22) Filed: Sep. 7, 2022

(65) Prior Publication Data

US 2023/0072180 A1 Mar. 9, 2023

Related U.S. Application Data

(60) Provisional application No. 63/241,230, filed on Sep. 7, 2021.

(51) Int. Cl.
*A63B 71/00* (2006.01)
*A63B 22/02* (2006.01)

(52) U.S. Cl.
CPC ..... *A63B 71/0054* (2013.01); *A63B 22/02* (2013.01); *A63B 2071/009* (2013.01)

(58) Field of Classification Search
CPC ..... A63B 22/02; A63B 71/0054; A63B 2071/009; A63B 22/0285; A63B 22/0235
See application file for complete search history.

(56) References Cited

U.S. PATENT DOCUMENTS

| | | | | |
|---|---|---|---|---|
| 6,860,839 | B1 * | 3/2005 | Dice | A63B 22/02 482/54 |
| 10,960,289 | B1 * | 3/2021 | Colcord | A63B 22/02 |
| 11,738,250 | B2 * | 8/2023 | Liao | A63B 24/0087 482/7 |
| 11,938,369 | B2 * | 3/2024 | Li | A63B 71/0054 |
| 2011/0009243 | A1 * | 1/2011 | Wu | A63B 22/02 482/54 |
| 2022/0362626 | A1 * | 11/2022 | Yoo | A63B 22/02 |

* cited by examiner

*Primary Examiner* — Megan Anderson
(74) *Attorney, Agent, or Firm* — AMPACC Law Group, PLLC

(57) ABSTRACT

An exercise machine with a movable belt includes a guard assembly with a flexible guard that extends towards the rear axis and is spaced apart from the movable belt by a first gap and is exposed by the housing body, a rigid guard positioned downstream of the flexible guard with respect to a moving direction of the belt and spaced apart from the movable belt by a second gap, and a channel disposed between the flexible guard and the rigid guard. The guard assembly protects the user from injury and prevents damage to the exercise machine.

20 Claims, 11 Drawing Sheets

GUARD ASSEMBLY FOR EXERCISE MACHINE

CROSS REFERENCE TO RELATED APPLICATIONS

This application claims priority to U.S. Provisional Patent Application No. 63/241,230, filed on Sep. 7, 2021, entitled GUARD ASSEMBLY FOR A TREADMILL, which is incorporated by reference in its entirety.

BACKGROUND

Exercise has become an increasingly important aspect of daily life, and most exercise regimens commonly involve the use of elliptical machines, stationary bicycles, rowing machines, treadmills, or other exercise machines. Such exercise machines are typically designed for use in a gym or other exercise facility and may not be concerned with an overall size or form factor. For example, a treadmill may have a motor and controls located in front of a deck where a user may run or walk. This configuration may provide accessibility to the motor and/or controls for maintenance purposes.

Many choose to perform aerobic exercises indoors, such as in a gym or their home. Often, a user uses an aerobic exercise machine to have an aerobic workout indoors. One type of aerobic exercise machine is a treadmill, which is a machine that has a running deck attached to a support frame. The running deck can support the weight of a person using the machine. The running deck incorporates a tread belt that is driven by a motor. A user can run or walk in place on the tread belt by running or walking at the tread belt's speed. The speed and other operations of the treadmill are generally controlled through a control module that is also attached to the support frame and within a convenient reach of the user.

The transition to home use is not without complications. Home users do not typically have knowledge and training for operating motorized equipment, so it is advantageous to introduce improved usability and safety features into treadmills to accommodate the variety of conditions that may be present in a home setting. These features can enhance usability and safety in treadmills that are used in any setting, including gyms, labs and a user's residence.

Overview

The devices, systems, and apparatuses of the present disclosure are directed to exercise machines, such as a treadmill or other exercise machine having a moving surface controlled by a motor. The moving surface moves over a deck or other supporting assembly, and can be a belt-based surface, a slat-based surface, or other type of surface that moves around the deck, enabling a user (e.g., a runner) to walk, jog, and/or run at different speeds or inclines.

In some embodiments, the various devices, systems, and apparatuses utilize mechanical assemblies and/or sensors to prevent, detect, and/or mitigate objects from entering or moving close to or under a treadmill or exercise machine.

In an embodiment, a treadmill includes a movable belt that rotates around a front axis and a rear axis and a guard assembly with a flexible guard that extends towards the rear axis and is spaced apart from the movable belt by a first gap and is exposed by the housing body, a rigid guard positioned downstream of the flexible guard with respect to a moving direction of the belt and spaced apart from the movable belt by a second gap, and a channel disposed between the flexible guard and the rigid guard.

The flexible guard may be configured to deform when an object larger than the first gap intrudes into the first gap, thereby increasing the size of the first gap. The first gap may be at least three times the size of the second gap. The first gap may be greater than 20 mm, and the second gap may be less than 10 mm. In an embodiment, an upper edge of the flexible guard is spaced apart from an upper edge of the rigid guard by at least 70 or 80 mm.

The treadmill may include a cover that covers a rear portion of the movable belt and exposes an upper surface of the flexible guard. In an embodiment, the flexible guard, the rigid guard, the belt and the cover define an elongated channel with a depth of at least 25 mm. The channel may be defined by a first surface of the rigid guard, a second surface of the rigid guard, the flexible guard, and the movable belt. The first surface of the rigid guard may be disposed at an angle of from 80 to 100 degrees with respect to the second surface of the rigid guard.

Features of the present disclosure may be embodied in a guard assembly for a movable belt, or an exercise machine with a movable belt.

BRIEF DESCRIPTION OF THE DRAWINGS

Embodiments of the present technology will be described and explained through the accompanying drawings.

Figure 1:
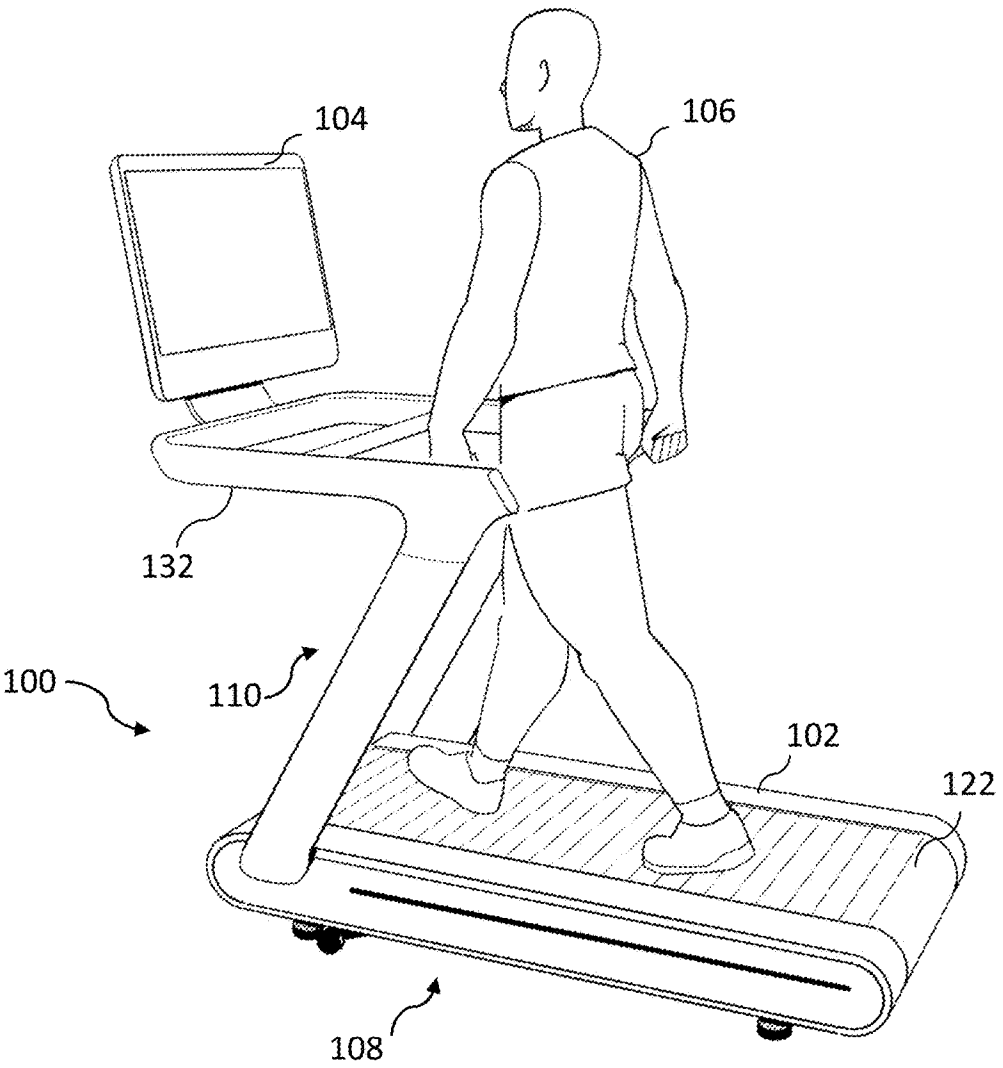
FIGS. 1 to 5 are diagrams illustrating various details of an exercise machine.

In the drawings, some components are not drawn to scale, and some components and/or operations can be separated into different blocks or combined into a single block for discussion of some of the implementations of the present technology. Moreover, while the technology is amenable to various modifications and alternative forms, specific implementations have been shown by way of example in the drawings and are described in detail below. The intention, however, is not to limit the technology to the particular implementations described. On the contrary, the technology is intended to cover all modifications, equivalents, and alternatives falling within the scope of the technology as defined by the appended claims.

DETAILED DESCRIPTION

Various devices, systems and methods that enhance an exercise activity performed by a user are described. In some embodiments, a guard, or guard assembly, is attached or otherwise fixed to a treadmill, such as to a rear or back portion of the treadmill. The guard assembly protects the treadmill or otherwise prevents objects, such as solid or deformable objects, from being pulled under the treadmill by a moving belt.

In some embodiments, the guard assembly includes an outer wall or flexible guard and an inner wall or rigid guard, which form a channel. The outer wall can include a deformable or flexible portion, which blocks objects from moving under the treadmill while moving out of the way when a force is applied. In some embodiments, the flexible portion may provide access into the channel to remove objects that may pass into the channel. The inner wall, which may be out of reach by the user (e.g., the user's fingers) via the channel, and may be taller and extend closer to the belt or surface than the outer wall.

Thus, the flexible guard may be configured to prevent objects from moving under the treadmill, without providing a pinch point, or other small gap between the guard and the surface or belt, in which a user's body part could become trapped. The inner wall or rigid guard may form a small gap, which could be a possible pinch point, but the rigid guard is placed or positioned under the treadmill at the back of the channel, and thus at a position that is generally inaccessible or unreachable to a user. Therefore, the guard assembly can facilitate the blocking or prevention of objects moving under the treadmill (via the moving surface or belt), without exposing small gaps between components to users of the treadmill, among other benefits.

In some embodiments, the treadmill can include an object detection mechanism, such as an infrared (IR) beam trigger mechanism, that is positioned under the deck of the treadmill (e.g., near the rear). The object detection mechanism can detect an object within the channel, moving within the channel, or otherwise under the treadmill, and modify operations of the treadmill, such as slowing down the moving surface, shutting off the moving surface, or otherwise adjusting to a different state of operation.

In some embodiments, the treadmill can include other mechanical or sensor-based detection mechanisms or components. For example, the treadmill can include one or more inclinometers, accelerometers, gyroscopes, or other sensors that can detect when a rear of a treadmill is moving upwards, tilting at an angle, or otherwise abnormally, and cause the treadmill to modify operations, such as slowing down, shutting off, or otherwise adjusting to a different state of operation.

Various embodiments of the apparatuses, devices, systems, and methods will now be described. The following description provides specific details for a thorough understanding and an enabling description of these embodiments. One skilled in the art will understand, however, that these embodiments may be practiced without many of these details. Additionally, some well-known structures or functions may not be shown or described in detail, so as to avoid unnecessarily obscuring the relevant description of the various embodiments. The terminology used in the description presented below is intended to be interpreted in its broadest reasonable manner, even though it is being used in conjunction with a detailed description of certain specific embodiments.

Referring generally to FIGS. 1 through 5, in various example embodiments of the present disclosure, a local system 100 may include an exercise machine 102, such as a treadmill, with integrated or connected digital hardware including one or more displays 104 for use in connection with an instructor lead exercise class and/or for displaying other digital content. While the exercise machine 102 may be described and/or otherwise referred to herein as a "treadmill 102," example exercise machines of the present disclosure may be other types of exercise machines with a movable belt or treads, such as a stair stepper.

In various example embodiments, the one or more displays 104 may be mounted directly to the exercise machine 102 or otherwise placed within view of a user 106. In various exemplary embodiments, the one or more displays 104 allow the user 106 to view content relating to a selected exercise class both while working out on the exercise machine 102 and while working out in one or more locations near or adjacent to the exercise machine 102. The exercise machine 102 may include a hinge, joint, pivot, bracket or other suitable mechanism to allow for adjustment of the position or orientation of the display 104 relative to the user 106 whether they are using the exercise machine 102 or working out near or adjacent to the exercise machine 102.

In example embodiments, the exercise machine 102 may generally include a lower assembly 108 and an upper assembly 110. The lower assembly 108 may generally include a deck 112 of the exercise machine 102 that provides support for the user 106 while the use is working out on the exercise machine 102, as well as other components of both the lower assembly 108 and the upper assembly 110. For example, as shown in at least the exploded view of FIG. 2, the deck 112 may support a first motor 114 of the exercise machine 102 configured to increase, decrease, and/or otherwise change an incline of the deck 112 relative to a support surface on which the exercise machine 102 is disposed. The deck 112 may also include one or more linkages 116 coupled to the motor 114 and configured to, for example, raise and lower the deck 112 by acting on the support surface when the motor 114 is activated. The deck 112 may also include a second motor 118 configured to increase, decrease, and/or otherwise change a rotational speed of a belt 120 connected to the deck 112.

The belt 120 may be rotatable relative to the deck 112 and may be configured to revolve or otherwise move completely around the deck 112 during use of the exercise machine 102. For example, in embodiments in which the exercise machine 102 comprises a treadmill, the belt 120 may support the user 106 and may repeatedly revolve around the deck 112 as the user 106 runs, walks, and/or otherwise works out on the treadmill. Such an example belt 120 may include one or more continuous tracks 122 movably coupled to a gear, flywheel, pulley, and/or other member 124 of the deck 112, and such a member 124 may be coupled to an output shaft or other component of the motor 118. In such examples, rotation of the output shaft or other component of the motor 118 may drive commensurate rotation of the member 124. Likewise, rotation of the member 124 may drive commensurate revolution of the one or more continuous tracks 122 and/or the belt 120 generally.

Figure 3:
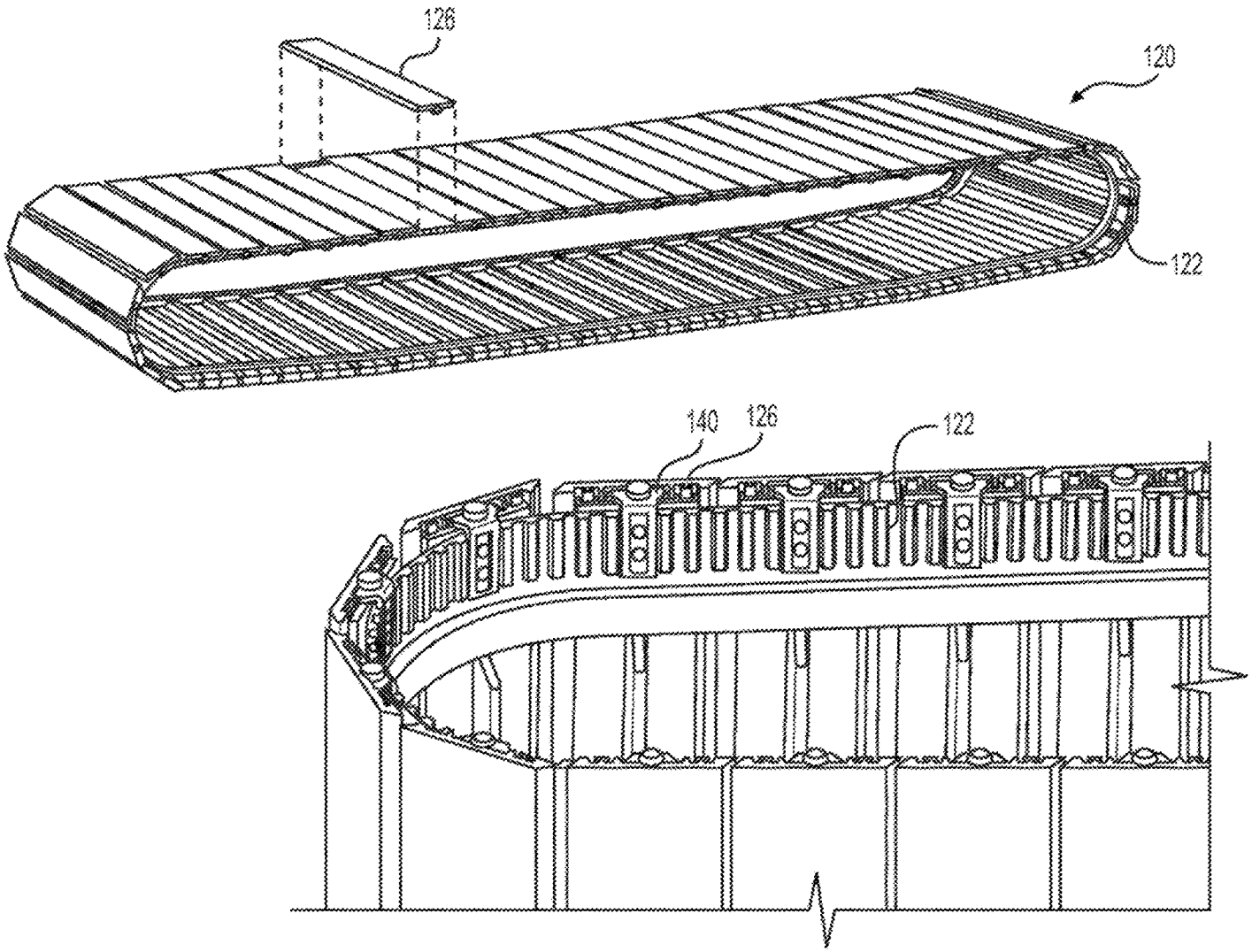
Figure 4:
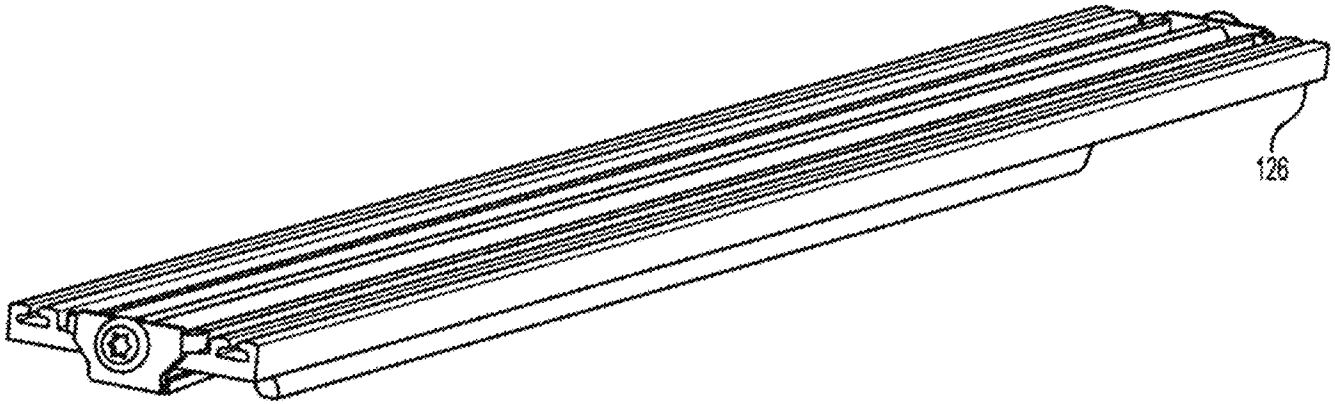
Figure 4:
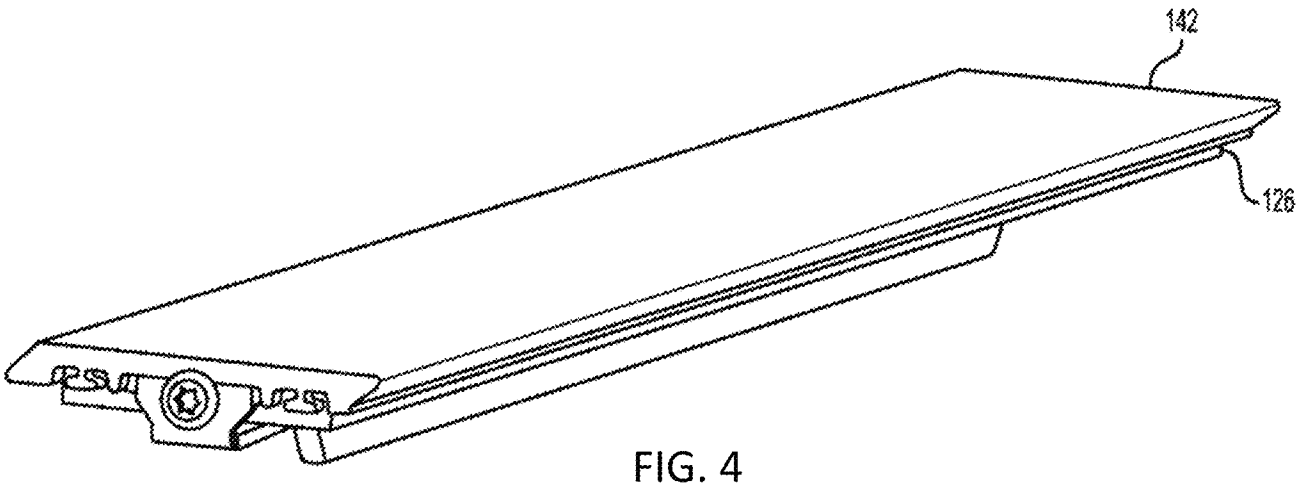

The belt 120 may also include a plurality of laterally aligned slats 126 connected to the one or more continuous tracks 122. For example, as shown in FIG. 3, each slat 126 may extend substantially parallel to at least one adjacent slat 126. Additionally, each slat 126 may be hingedly, pivotally, and/or otherwise movably coupled to the one or more continuous tracks 122 via one or more respective couplings 140. Such couplings 140 may comprise, for example, a bracket, pin, screw, clip, bolt, and/or one or more other fastening components configured to secure a respective slat 126 to the continuous track 122 while allowing the slat 126 to pivot, rotate, and/or otherwise move relative to the track 122 while the belt 120 revolves about the deck 112. As shown in at least FIG. 4, each slat 126 may also include a top pad 142 coupled thereto. The top pad 142 may comprise a plastic, rubber, polymeric, and/or other type of non-slip pad configured to reduce and/or substantially eliminate slipping of the user 106 when the user is running, walking, and/or otherwise exercising on the exercise machine 102. Such a top pad 142 may also reduce the impact associated with walking and/or running on the exercise machine 102, and may thus improve the comfort of the user 106 during various exercise classes associated with the exercise machine 102.

Figure 2:
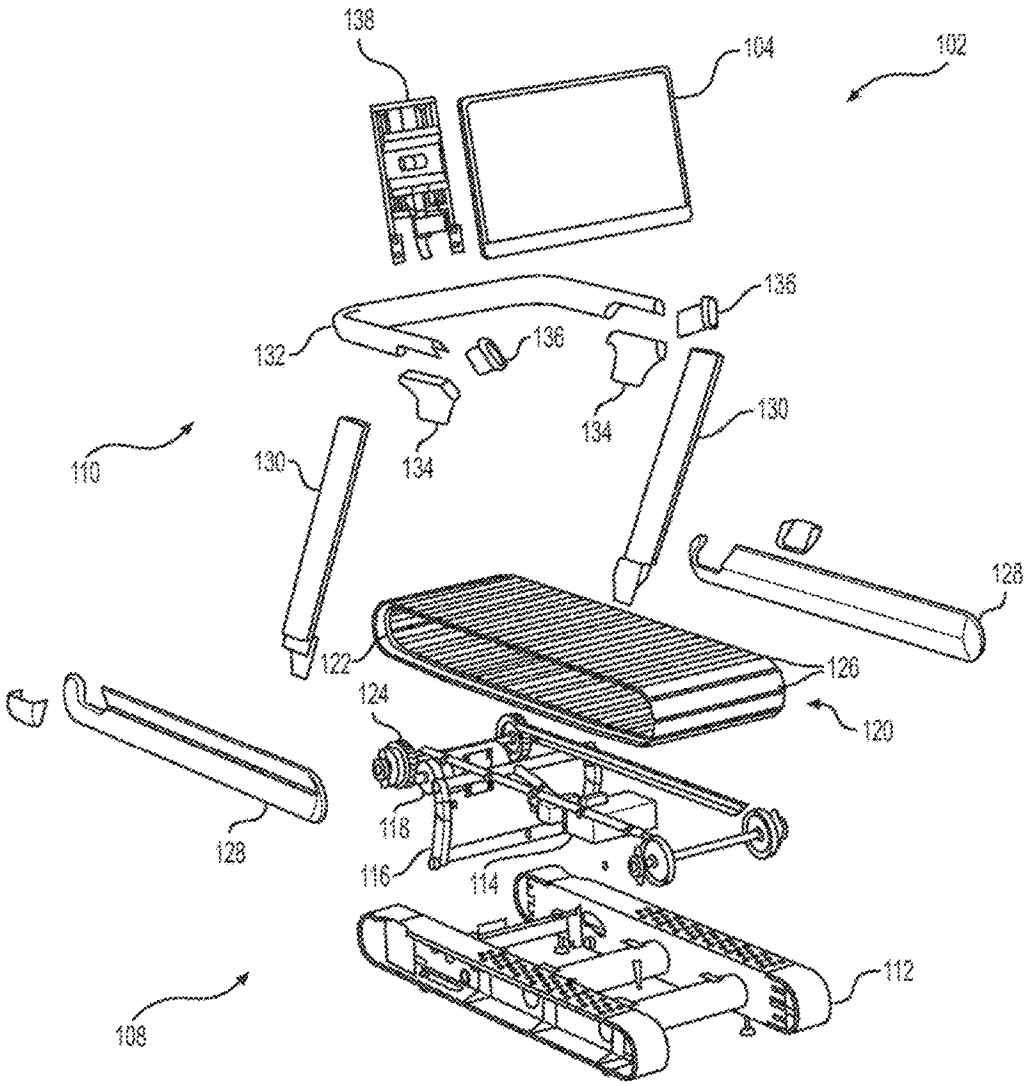

With continued reference to FIG. 2, the exercise machine 102 may also include one or more sidewalls 128 connected to the deck 112. For example, the exercise machine 102 may include a first sidewall 128 on a left hand side of the deck 112, and a second sidewall 128 on the right hand side of the deck 112. Such sidewalls 128 may be made from cloth, foam, plastic, rubber, polymers, and/or other like material, and in some examples, the sidewalls 128 may assist in damping and/or otherwise reducing noise generated by one or more of the motors 114, 118 and/or other components of the deck 112.

The exercise machine 102 may also include one or more posts 130 extending upwardly from the deck 112. For example, the exercise machine 102 may include a first post 130 on the left hand side of the deck 112, and a second post 130 on the right hand side of the deck 112. Such posts 130 may be made from a metal, alloy, plastic, polymer, and/or other like material, and similar such materials may be used to manufacture the deck 112, the slats 126, and/or other components of the exercise machine 102. In such examples, the posts 130 may be configured to support the display 104, and in some examples, the display 104 may be directly coupled to a crossbar 132 of the exercise machine 102, and the crossbar 132 may be connected to and/or otherwise supported by the posts 130. For example, the crossbar 132 may comprise one or more hand rests or handles useful in supporting the user 106 during exercise.

In some examples, the crossbar 132 may be substantially C-shaped, substantially U-shaped, and/or any other configuration. In any of the examples described herein, the crossbar 132 may extend from a first one of the posts 130 to a second one of the posts 130. Further, in some examples, the posts 130 and the crossbar 132 may comprise a single integral component of the upper assembly 110. Alternatively, in other examples, the posts 130 and the crossbar 132 may comprise separate components of the upper assembly 110. In such examples, the upper assembly 110 may include one or more brackets 134, endcaps 136, and/or additional components configured to assist in coupling the one or more posts 130 to the crossbar 132.

As noted above, the exercise machine 102 may also include a hinge, joint, pivot, bracket 138 and/or other suitable mechanism to allow for adjustment of the position or orientation of the display 104 relative to the user 106 whether they are using the exercise machine 102 or working out near or adjacent to the exercise machine 102. For example, such brackets 138 may include at least one component rigidly connected to the crossbar 132. Such brackets 138 may also include one or more additional components rigidly coupled to the display 104. In such examples, the components of the bracket 138 connected to the display 104 may be moveable, with the display 104 relative to the components of the bracket 138 connected to the crossbar 132. Such components may include one or more dove-tail slider mechanism, channels, and/or other components enabling the display 104 to controllably slide and/or otherwise move relative to the crossbar 132. Such components may also enable to the user 106 to fix the position of the display 104 relative to the crossbar 132 once the user 106 has positioned the display 104 as desired.

Figure 5:
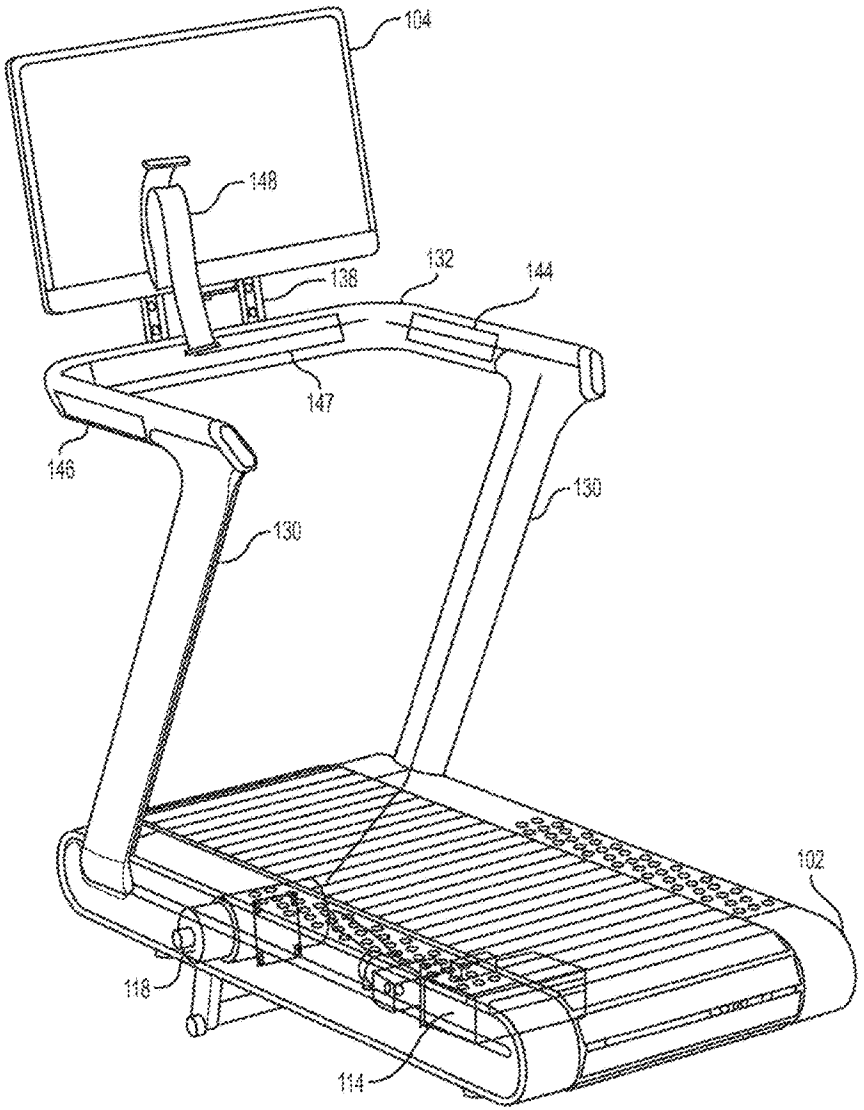

As shown in at least FIG. 5, the exercise machine 102 may also include one or more controls 144, 146 configured to receive input from the user 106. The exercise machine 102 may further include one or more sensors 147 configured to sense, detect, and/or otherwise determine one or more performance parameters of the user 106 before, during, and/or after the user 106 participates in an exercise class using the exercise machine 102. In any of the examples described herein, the controls 144, 146 and the one or more sensors 147 may be operably and/or otherwise connected to one or more controllers, processors, and/or other digital hardware 148 of the exercise machine 102.

The digital hardware 148 associated with the exercise machine 102 may be connected to or integrated with the exercise machine 102, or it may be located remotely and wired or wirelessly connected to the exercise machine 102. The digital hardware 148 may include digital storage, one or more processors or other like computers or controllers, communications hardware, software, and/or one or more media input/output devices such as displays, cameras, microphones, keyboards, touchscreens, headsets, and/or audio speakers. In various exemplary embodiments these components may be connected to and/or otherwise integrated with the exercise machine 102.

All communications between and among such components of the digital hardware 148 may be multichannel, multi-directional, and wireless or wired, using any appropriate protocol or technology. In various exemplary embodiments, the digital hardware 148 of the exercise machine 102 may include associated mobile and web-based application programs that provide access to account, performance, and other relevant information to users from local or remote exercise machines, processors, controllers, personal computers, laptops, mobile devices, or any other digital device or digital hardware. In any of the examples described herein, the one or more controllers, processors, and/or other digital hardware 148 associated with the exercise machine 102 may be operable to perform one or more functions associated with control logic of the exercise machine 102. Such control logic may comprise one or more rules, programs, or other instructions stored in a memory of the digital hardware 148. For example, one or more processors included in the digital hardware 148 may be programmed to perform operations in accordance with rules, programs, or other instructions of the control logic, and such processors may also be programmed to perform one or more additional operations in accordance with and/or at least partly in response to input received via one or more of the controls 144, 146 and/or via one or more of the sensors 147.

As described herein, in some embodiments, a guard assembly 150 includes two separate guard walls 152 and 154, which prevent injurious gaps between the assembly 150 and a moving belt 120 of an exercise machine 102 from being exposed and/or contacted by a user, such as by a user's hand, fingers, foot, toes, and so on. The guard assembly 150 may provide safety for the user by preventing the user's body from being caught between the belt 120 and other components of the exercise machine 102 or the ground, and prevent damage to the exercise machine 102 by blocking objects larger than the gaps. More specifically, a flexible guard 152 of the guard assembly 150 may prevent objects from passing by a first gap 156, and the flexible guard 152 may deflect when an object larger than the gap enters the first gap 156 allowing the object to pass, thereby preventing damage or injury to the object and the exercise machine 102. In addition, the flexibility of the flexible guard 152 may allow for the manual extraction of an object that passes the first gap 156 from channel 162. A rigid guard 154 located downstream of the flexible guard 152 with respect to a moving direction of the belt 120 stops objects that passed through the first gap 156 by presenting a limited space between the rigid guard 154 and belt 120 as a second gap 158.

The flexible guard 152 can flex or be deformed, such that an access area into the channel 162 between the guards has a height or geometry that avoids formation of a pinch point between a portion of the channel 162 and the slats of the belt 120. Thus, the flexible guard 152 is flexible and can elastically deform (e.g., bend inwards or outwards) under relatively small loads, mitigating formation of small gaps or small, rigid, points of contact near the belt 120 that may possibly cause injury to a user.

Figure 6:
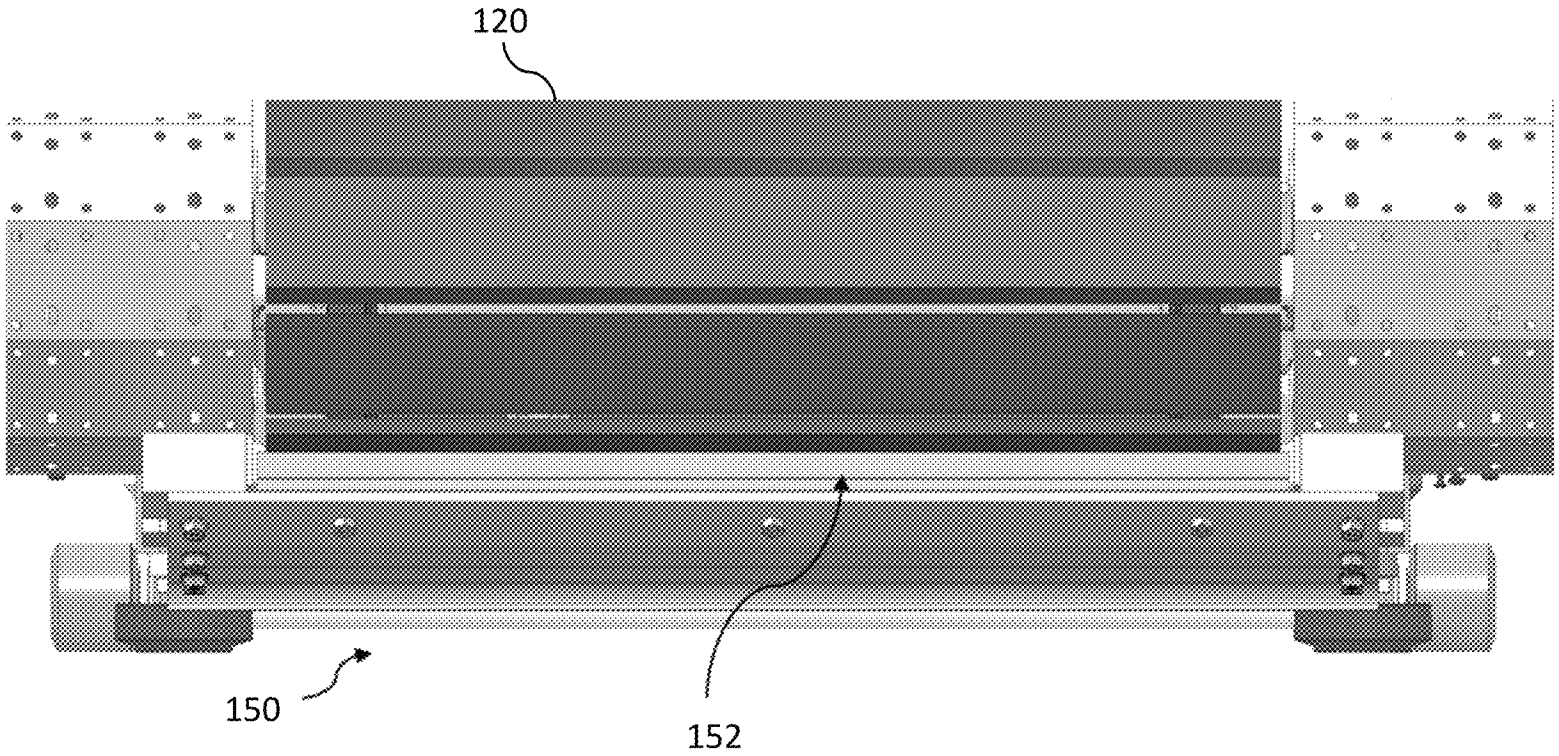
FIGS. 6 to 11 are diagrams illustrating various details of a guard assembly coupled to an exercise machine.
Figure 7:
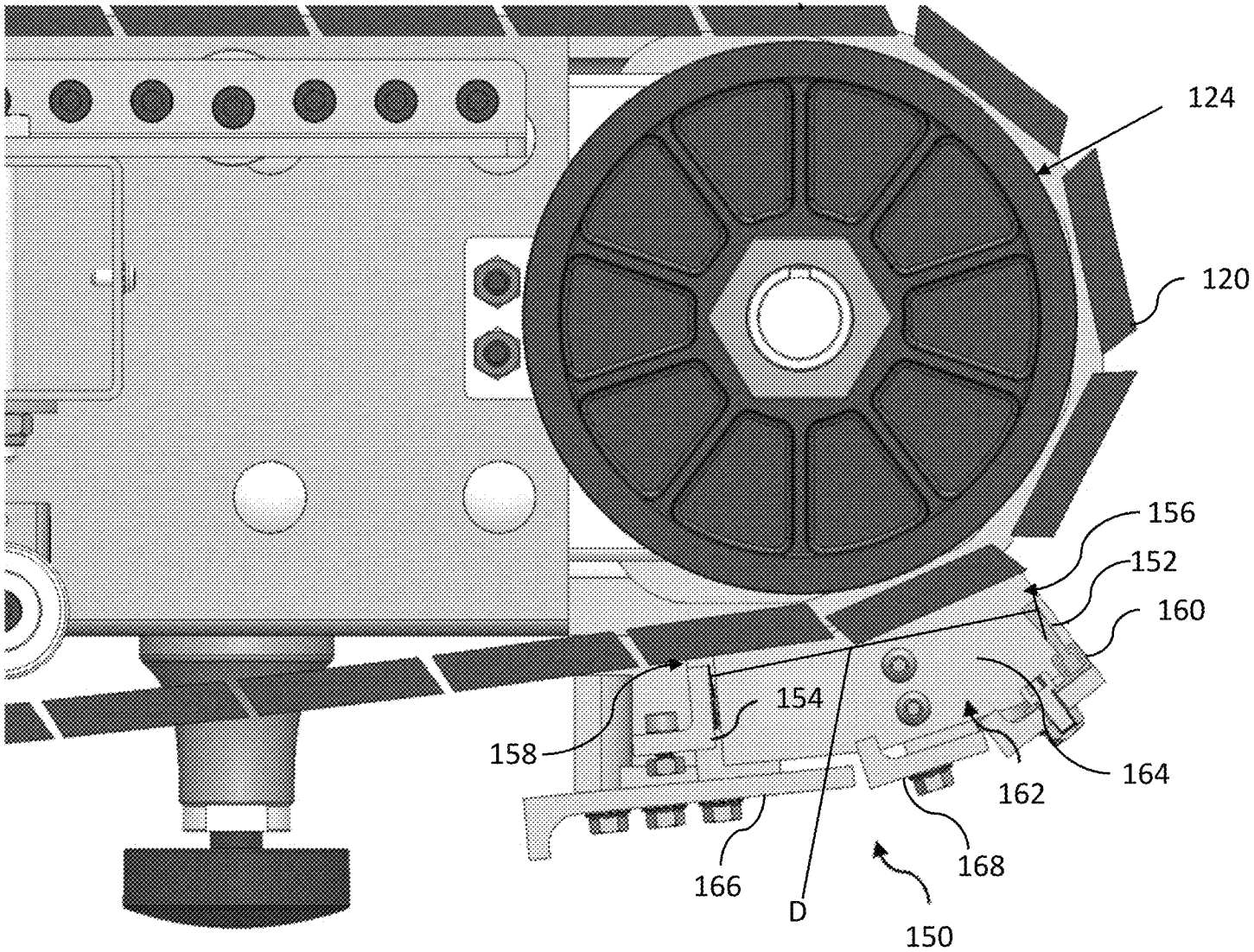
Figure 8:
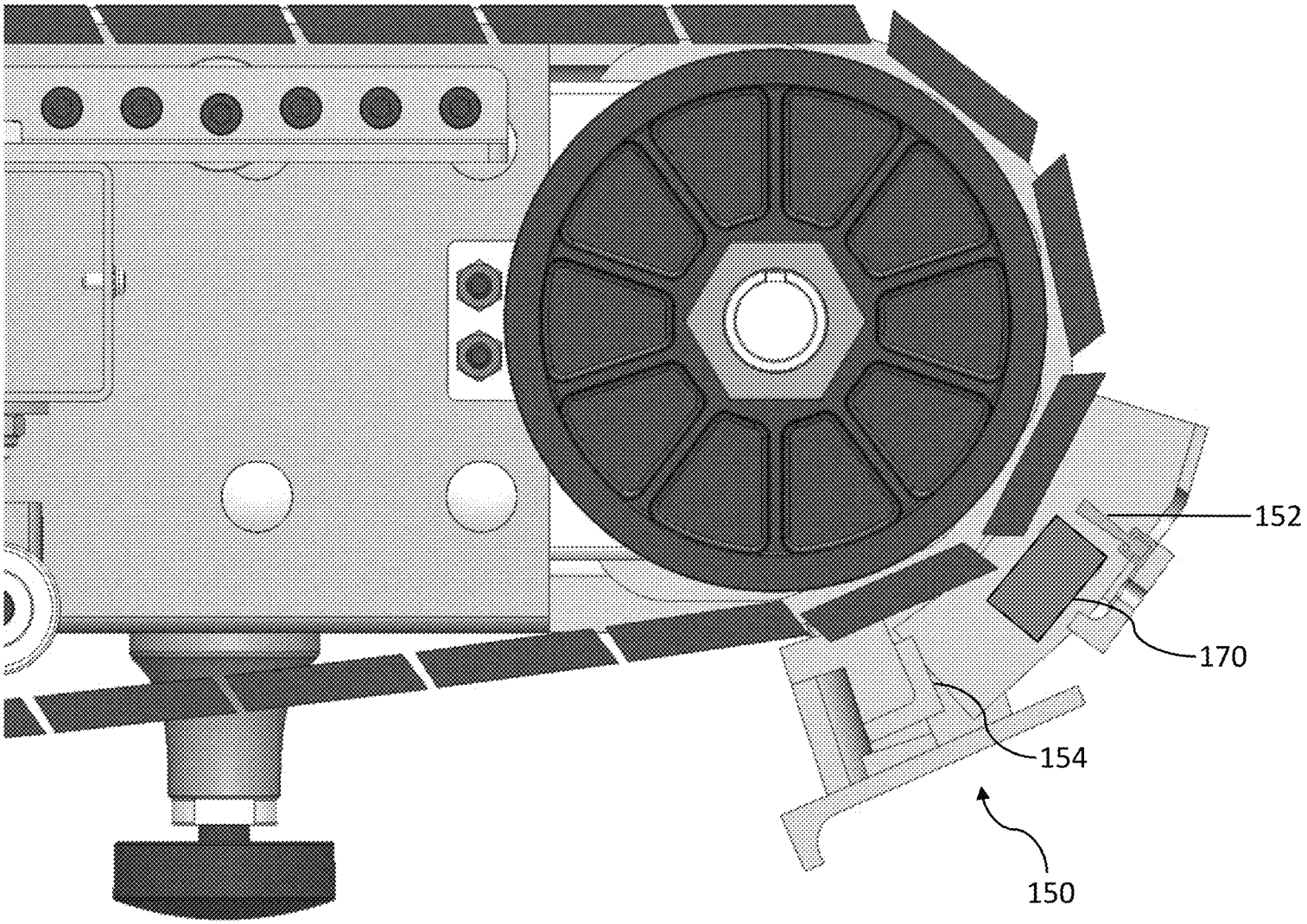
Figure 9:
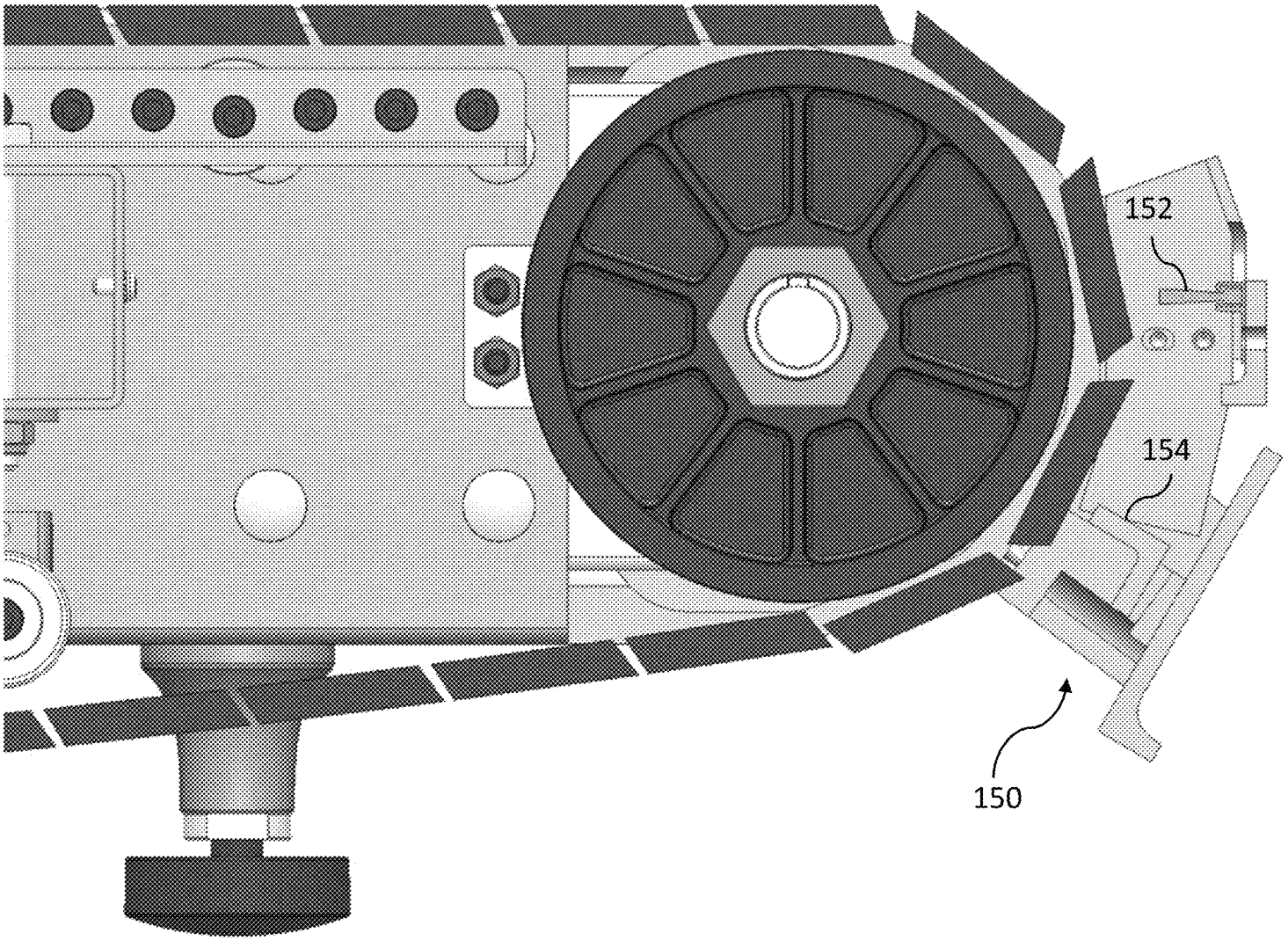

FIG. 6 is a rear view of an embodiment of a treadmill 102 that includes a guard assembly 150, and FIGS. 7-9 are cross-sectional views of a guard assembly in different radial positions with respect to an axis of rotating member or wheel 124.

As seen in FIG. 7, the guard assembly is coupled to a rear portion of the treadmill. A flexible guard 152 spans the entire width of the belt 120, and is exposed by the guard assembly 150 so that an object travelling along the belt 120 as it rotates would collide with the flexible guard 152. In addition, if a user attempts to reach grasp an object that is moving on the belt, the user's fingers would encounter the flexible guard 152.

A flexible guard 152 may comprise a material such as a rubber. Suitable materials include butyl rubber, silicon rubber, polyamide, various rubber block copolymers as known in the art, and generally elastic materials such as low density polyethylene. In some embodiments, the guard may comprise a plurality of bristles, e.g. polyamide bristles. The flexible material of the flexible guard may extend for a distance of from 25 to 30 mm.

The flexible guard 152 may be configured to maintain its original orientation to block loose objects such as a towel or clothing item from proceeding along the belt 120, while having sufficient flexibility to deform and enlarge the size of first gap 156 when an object larger than the first gap 156 enters first gap 156. Accordingly, the flexible guard 152 may block objects that exert a relatively low force against the flexible guard 152, and deform to allow objects that exert a higher force to pass.

In the embodiments shown in FIGS. 6-9, the flexible guard 152 includes a solid body that is elongated in the transverse direction of the belt 120 so that it spans across the entire width of the belt 120, and extends inwards from where the guard is fixed to the guard assembly 150 in a radial direction towards the belt 120. In an embodiment, the flexible guard 152 is substantially perpendicular to the belt 120. The least dimension of the flexible guard 152 is the thickness, which allows the flexible guard to deform away from the path of belt 120. When the flexible guard 152 is a brush, the diameter, material, and density of the bristles are adapted to provide appropriate levels of flexibility.

As seen in FIGS. 7-9, the flexible guard 152 may taper inwards so that it has a decreasing thickness in a direction away from the belt, which encourages the guard to flex at its base where the guard attaches to a rigid part of guard assembly 150. In addition, the flexible guard 152 may be mounted in a housing 160 that encloses a far end of the flexible guard 152 and causes the guard to pivot about the point where it emerges from the housing. The housing 160 may therefore both provide a rigid base that holds one edge of the flexible guard 152 in place with respect to the guard assembly 150, and promote deformation at the base of the guard 152 around a fulcrum provided by the housing 160.

The guard assembly 150 further includes a second guard that is a rigid guard 154. The rigid guard 154 may comprise an inelastic material that may be a metal material, such as aluminum or steel, or a polymer such as nylon, polyester or ABS. The rigid guard 154 is spaced apart from the belt 120 by a second gap 158, which may be smaller than the first gap 156. For example, the second gap may be 10 mm or less or 5 mm or less, and the first gap 156 may be greater than 20 mm or greater than 25 mm. In some embodiments, first gap 156 may be from 25 to 30 mm. Accordingly, the first gap 156 may be at least three, four or five times the size of the second gap 158.

The rigid guard 154 may prevent objects that have passed through the first gap 156 from travelling further along the direction of the belt 120. However, the second gap 158 is not directly exposed to a user. In an embodiment, even if the second gap is encountered by an appendage or object via the channel 162, the rigid guard 154 may be positioned such that it meets the slats at an angle that would prevent a slat from pushing a user's hand or finger further under the deck 112, e.g. an angle that is either substantially perpendicular or has a forward rake with respect to the belt 120 as it approaches the rigid guard 154. The position of rigid guard 154 may be adjustable to adjust the size of the second gap 158, or fixed in a single position. In an embodiment, the rigid guard 154 has an elongated body that extends towards the belt 120 at an angle that is substantially perpendicular to the belt 120.

The leading edge of rigid guard 154 is spaced apart from the leading edge of flexible guard 152 by a distance "D" that may be greater than a typical length of a human finger. The distance between the two guards may be sufficient so that even if a user's fingers pass beyond the flexible guard 152 along the belt, they would not reach the rigid guard 154. The distance D may be, for example, 80 mm, 85 mm, 90 mm, or 100 mm or greater as measured from the upper surface of the flexible guard 156. The flexible guard 156 may have a thickness of from 10 to 15 mm.

Furthermore, the guard assembly 150 may be configured to prevent a user's entire hand from passing the flexible guard 152 into the channel or cavity 162 disposed between the two guards. This may be accomplished by the configuration of the flexible guard 152 and the guard assembly 150. For example, the distance between a rigid component of the guard assembly 150 and the belt 120 (e.g. a housing 160), which may be further restricted by a deformed flexible guard 154, may prevent a user's hand from passing into cavity 162 even when aided by the force of a moving belt 120.

The flexible guard 152, the rigid guard 154, and the sides 164 and one or more outer panel 166 of guard assembly 150 may collectively form a cavity or channel 162. The cavity 162 may collect debris and objects that have passed the flexible guard 152 but were stopped by the rigid guard 154. In an embodiment, access to the cavity 162 is provided by a removable panel 168 to retrieve objects and clean the assembly. In another embodiment, users are not provided with direct access to the cavity 162 without disassembling the guard assembly 150 and/or a rear portion of the exercise machine 102.

In an embodiment, the channel 162 has a generally elongated configuration with respect to the belt 120. That is, a depth of the channel 162 may be significantly less than the length of the channel, so that the channel 162 causes or guides a user's finger or hand to move parallel to the belt 120, and thus avoids or mitigates the possibility that a body part or object that passes the flexible guard 152 would engage with the second gap 158 at an angle that causes the body part or object to pinch or wedge into the second gap 158. Instead, the body part or object is directed to the body of the rigid guard 154, which stops the body part or object from passing further without causing damage or injury, Thus, the channel 162, in some cases, guides a user's fingers, arm, or hand in a direction that is generally parallel to the moving belt 120 of the treadmill.

In an embodiment, the length of channel 162 measured between the inner faces of the rigid and flexible guards is greater than 60 mm or 70 mm. For example, the length of channel 162 may be from 60 to 80 mm or from 70 to 75 mm. The channel 162 may have a depth, or distance between belt 120 and a third portion of the rigid guard member, of from 30 and 60 mm, from 40 to 60 mm, or from 50 to 60 mm. The narrowest point of channel 162 may be 30 mm or more, and the widest point of channel 162 may be 70 mm or less.

FIGS. 8 and 9 show embodiments of a guard assembly 150 with similar configurations to the guard assembly of FIG. 7, except that the embodiments of FIGS. 8 and 9 are located at different positions along the arc of belt 120 as it passes over the wheel 124. In and embodiment, the guard assembly 150 may be rotatable to adjust the position between one or more of the orientations shown in FIGS. 7-9. In another embodiment, the guard assembly 150 is fixed in a single position.

In FIGS. 8 and 9, the rigid guard 154 is positioned at a different arc position along the radial part of the belt 120 from the flexible guard 152, so that an object that passes flexible guard 152 would have to rotate to encounter the rigid guard 154. This geometry presents and additional measure of safety and protection.

Figure 10:
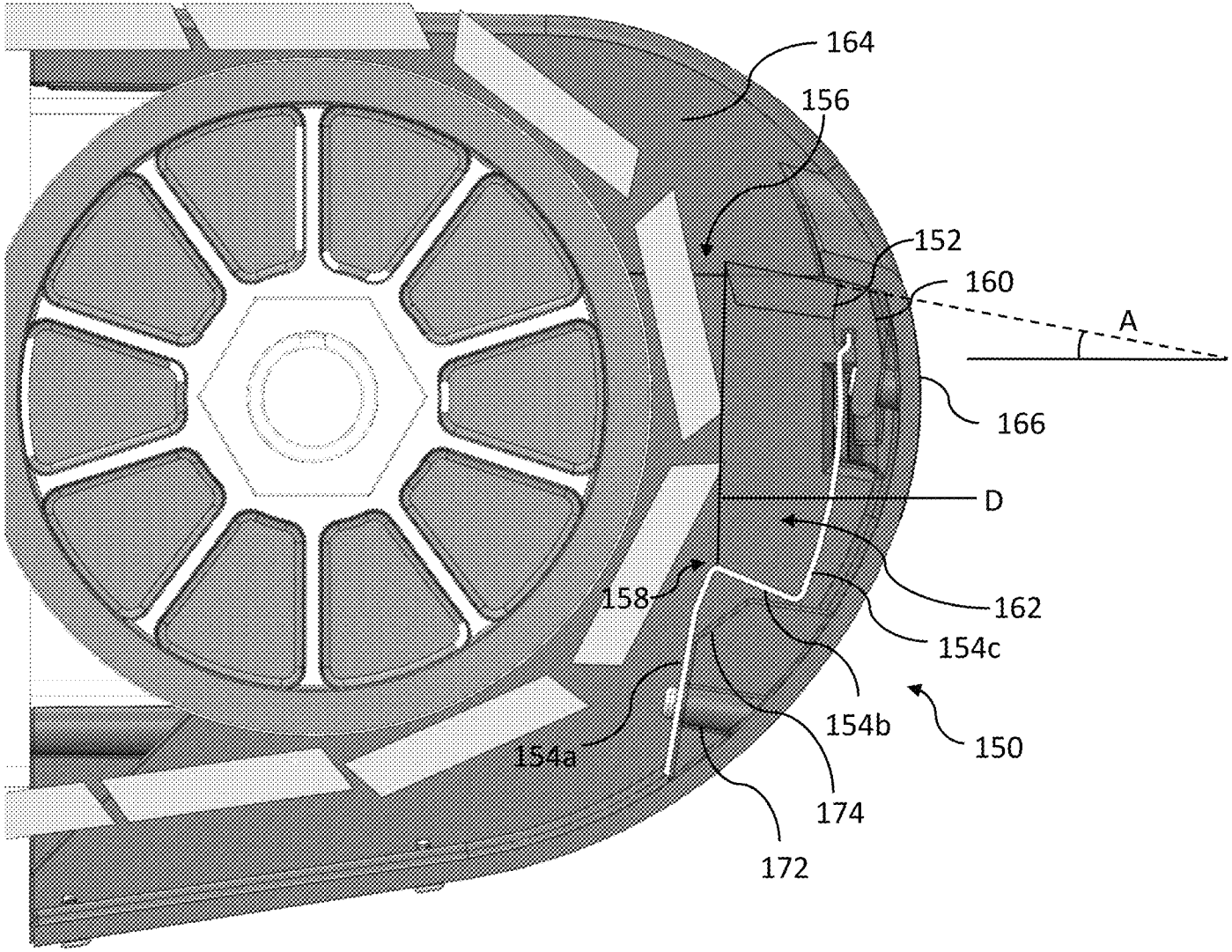

FIG. 10 shows another embodiment of a guard assembly 150. In the embodiment of FIG. 10, the rigid guard 154 comprises a thin stamped metal member that is screwed to molded outer panel 166 through a boss 172 at one end, and is inserted into a pocket in the housing 160 at the opposite end. The stamped metal member is bent to form the guard part which presents a second gap 158. The guard part rests against a molded body 174 which houses the boss 172, and the molded body provides a hard stop that prevents the rigid guard 154 from deforming in the direction of belt travel. This configuration provides rigidity and stability when a relatively thin member is used for the rigid guard 154.

In the embodiment of FIG. 10, the rigid guard 154 defines two sides of the channel 162. Specifically, with respect to the orientations shown in FIG. 10, a lower or bottom side of the channel 162 is defined by a guard portion 154*b* of the rigid guard member 154, and a right side of the channel 162 is also defined by a third portion of the rigid guard member 154*c*. One end of the rigid guard member 154 rests against a surface of the molded body 174, an second portion of the guard member 154*b* that provides the guard portion is bent at a first angle that is between 80 and 100 degrees, or substantially perpendicular, with respect to the end portion or first portion 154*a*, and a third portion of the guard member 154*c* is bent at a second angle that is between 80 and 100 degrees, or substantially perpendicular to the second portion 154*b*. Accordingly, the first portion 154*a* of the guard member of rigid guard 154 may be substantially parallel to the third portion 154*c* of the guard member, while a middle or second portion 154*b* is substantially perpendicular to the first and third portions 154*a* and 154*c*. In addition, the second or guard portion 154*b* of the guard member 154 may abut the same molded body 174 to which the first portion 154*a* is affixed. Here, the terms "first" "second" and "third" are only used to differentiate between different parts of the guard 154.

Figure 11:
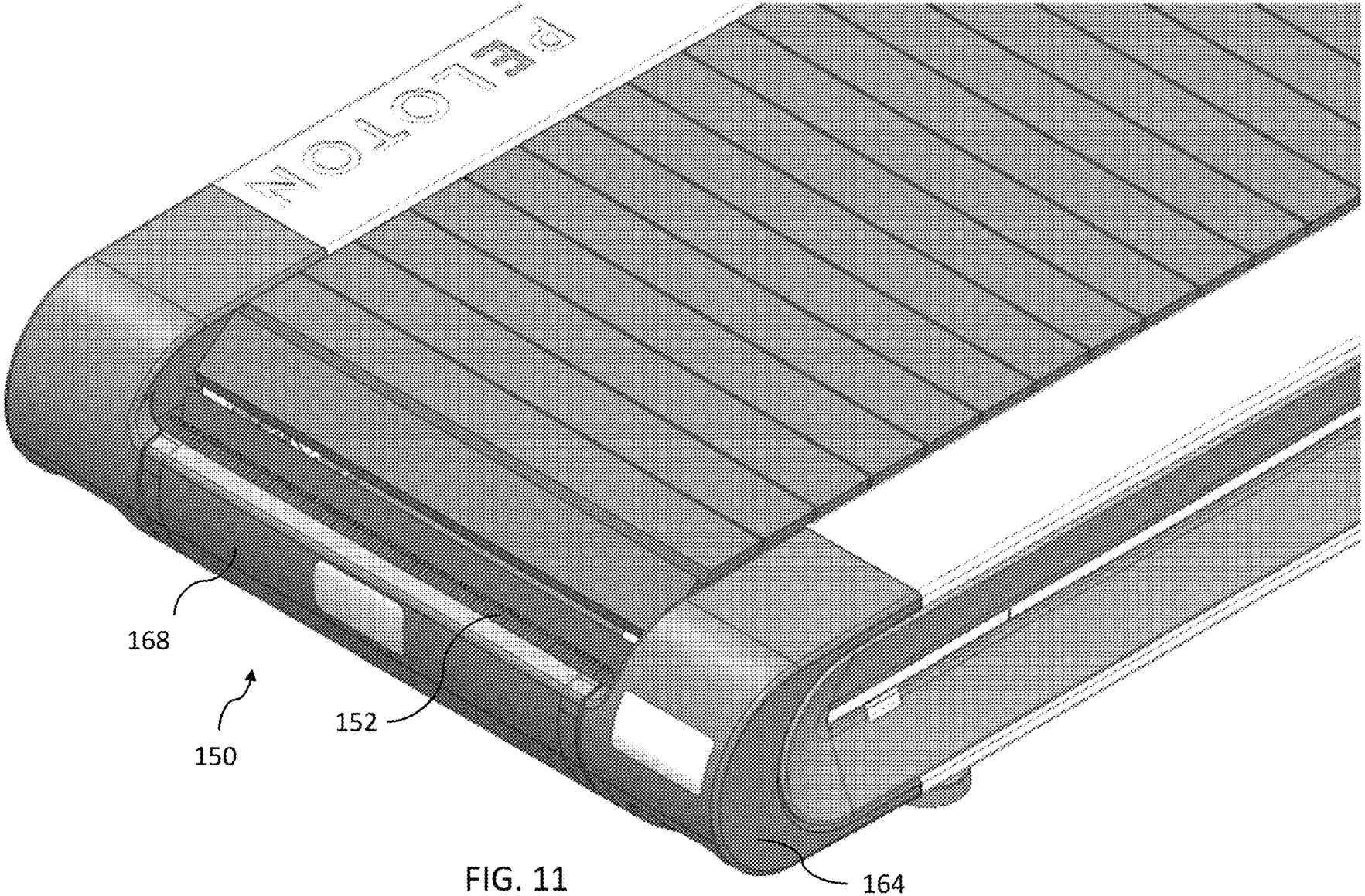

FIG. 11 illustrates a rear view of the deck of a treadmill 102 that includes a guard assembly 150. The flexible guard 152 is exposed by the guard assembly 150 so that objects on the belt 120 encounter the flexible guard 152 as they pass along the belt 120. As illustrated in FIG. 10, the flexible guard 152 may have its leading edge surface raised at an angle A above horizontal so that such objects are deflected backwards from the treadmill 102. Angle A may be, for example, at least 10, 15, 20, 25 or 30 degrees. This angle also reduces the possibility that objects or limbs would accidentally intrude into the cavity 162. In addition, the belt-facing surface of the flexible guard 152 may taper inwards with respect to a moving direction of the belt 120 to facilitate extraction of objects that have passed through the first gap 156. The taper may be 10 degrees or more with respect to the upper flat surface of the flexible guard 152.

The guard assembly 150 can include different geometries, different channel lengths (e.g., distances between walls or stoppers), different channel internal area sizes, and so on. Also, in some cases, the guard assembly can include more than two walls or stoppers, such as walls providing various gaps, to prevent different sized objects from entering under the treadmill. Thus, the guard assembly includes configurations or components that prevent or mitigate the movement of objects to the underside of the treadmill while also protecting the user from pinch points and other contact type areas that may injure or harm a user, among other benefits.

In some cases, the guard assembly 150 is connected to a safety controller or other control board that is part of digital hardware 148 of the treadmill 102. In response to detecting an object within the channel 162 or movement of the flexible guard 152, the assembly can send a signal to the safety control board of digital hardware 148. The treadmill 102, in response, can perform various control operations, such as slowing down, shutting off, presenting an alert or warning, and so on.

As illustrated in FIG. 8, in some embodiments, the treadmill 102 can include an infrared beam (IR) trigger mechanism 170 that is positioned under the deck of the treadmill (e.g., near the rear), and may be part of the guard assembly 150. The trigger mechanism 170 can detect an object impinging on an IR beam or multiple IR beams), and modify current operations, such as slowing down, shutting off, or otherwise adjusting to a different state of operation. In another embodiment, the trigger mechanism or sensor 170 is a mechanical switch.

For example, when an object moves or is located under the deck or within the channel 162, the object contacts or impinges the IR beam, causing the sensor 170 to not receive the beam. When the sensor 170 does not receive the beam, the sensor can send a signal to the treadmill (e.g., to a safety control board of the treadmill) that indicates an object is likely under or moving under the deck of the treadmill or is within the channel 162. In response, the treadmill 102 can slow down, shut off, alert a user, or otherwise adjust or modify to a different state of operation. The treadmill 102 can use other detection mechanisms, such as computer vision or other imaging-based detection mechanisms, and so on.

As described herein, in some embodiments, the treadmill 102 can include other mechanical or sensor-based detection mechanisms or components. For example, the treadmill can include one or more inclinometers, accelerometers, gyroscopes, or other sensors that can detect a rear of a treadmill is moving upwards, tilting at an angle, or otherwise abnormally, and cause the treadmill to modify current operations, such as slowing down, shutting off, or otherwise adjusting to a different state of operation.

A treadmill or other similar exercise machine 102 can employ or implement various combinations of the mechanical assemblies and sensors described herein. For example, a first assembly can be utilized to prevent objects from entering or moving under the deck, while a sensor can also be utilized to perform a shut-down operation (or other mitigation operation) when an object may enter or otherwise not be prevented by moving under the deck. Thus, a treadmill can incorporate various combinations of the technologies described herein.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or", in reference to a list of two or more items, covers all of the following interpretations of the word: any of the items in the list, all of the items in the list, and any combination of the items in the list. The term "substantially" accommodates engineering tolerances, e.g. plus or minus 5%.

The above detailed description of embodiments of the disclosure is not intended to be exhaustive or to limit the teachings to the precise form disclosed above. While specific embodiments of, and examples for, the disclosure are described above for illustrative purposes, various equivalent modifications are possible within the scope of the disclosure, as those skilled in the relevant art will recognize.

The teachings of the disclosure provided herein can be applied to other systems, not necessarily the system described above. The elements and acts of the various embodiments described above can be combined to provide further embodiments.

These and other changes can be made to the disclosure in light of the above Detailed Description. While the above description describes certain embodiments of the disclosure, and describes the best mode contemplated, no matter how detailed the above appears in text, the teachings can be practiced in many ways. Details of the technology may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features, or aspects of the disclosure with which that terminology is associated. In general, the terms used in the following claims should not be construed to limit the disclosure to the specific embodiments disclosed in the specification, unless the above Detailed Description section explicitly defines such terms. Accordingly, the actual scope of the disclosure encompasses not only the disclosed embodiments, but also all equivalent ways of practicing or implementing the disclosure under the claims.

From the foregoing, it will be appreciated that specific embodiments have been described herein for purposes of illustration, but that various modifications may be made without deviating from the spirit and scope of the embodiments. Accordingly, the embodiments are not limited except as by the appended claims.

What is claimed is:

1. A treadmill comprising:

a movable belt that rotates around a front axis and a rear axis; and a guard assembly comprising:

a flexible guard that extends towards the rear axis and is spaced apart from the movable belt by a first gap and is exposed by a housing body;

a rigid guard positioned downstream of the flexible guard with respect to a moving direction of the belt and spaced apart from the movable belt by a second gap; and a channel disposed between the flexible guard and the rigid guard.

2. The treadmill of claim 1, wherein the channel is defined by a first surface of the rigid guard, a second surface of the rigid guard, the flexible guard, and the movable belt.

3. The treadmill of claim 2, wherein the first surface of the rigid guard is disposed at an angle of from 80 to 100 degrees with respect to the second surface of the rigid guard.

4. The treadmill of claim 1, wherein the flexible guard is configured to deform when an object larger than the first gap intrudes into the first gap, thereby increasing the size of the first gap.

5. The treadmill of claim 1, wherein the first gap is at least three times the size of the second gap.

6. The treadmill of claim 1, wherein the first gap is greater than 20 mm, and the second gap is less than 10 mm.

7. The treadmill of claim 1, wherein an upper edge of the flexible guard is spaced apart from an upper edge of the rigid guard by at least 70 mm.

8. The treadmill of claim 1, further comprising a cover that covers a rear portion of the movable belt and exposes an upper surface of the flexible guard.

9. A guard assembly for a movable belt, the guard assembly comprising:

a flexible guard that extends towards a rear axis and is spaced apart from the movable belt by a first gap and is exposed by a housing body;

a rigid guard positioned downstream of the flexible guard with respect to a moving direction of the movable belt and spaced apart from the movable belt by a second gap; and a channel disposed between the flexible guard and the rigid guard.

10. The guard assembly of claim 9, wherein the flexible guard is configured to deform when an object larger than the first gap intrudes into the first gap, thereby increasing the size of the first gap.

11. The guard assembly of claim 9, wherein the first gap is at least three times the size of the second gap.

12. The guard assembly of claim 9, wherein the first gap is greater than 20 mm, and the second gap is less than 10 mm.

13. The guard assembly of claim 9, wherein an upper edge of the flexible guard is spaced apart from an upper edge of the rigid guard by at least 70 mm.

14. The guard assembly of claim 9, wherein the channel is defined by a first surface of the rigid guard, a second surface of the rigid guard, the flexible guard, and the movable belt.

15. An exercise machine with a movable belt, the exercise machine comprising:

a flexible guard that extends towards a rear axis and is spaced apart from the movable belt by a first gap and is exposed by a housing body;

a rigid guard positioned downstream of the flexible guard with respect to a moving direction of the movable belt and spaced apart from the movable belt by a second gap; and a channel disposed between the flexible guard and the rigid guard.

16. The exercise machine of claim 15, wherein the flexible guard is configured to deform when an object larger than the first gap intrudes into the first gap, thereby increasing the size of the first gap.

17. The exercise machine of claim 15, wherein the first gap is at least three times the size of the second gap.

18. The exercise machine of claim 15, wherein the first gap is greater than 20 mm, and the second gap is less than 10 mm.

19. The exercise machine of claim 15, wherein an upper edge of the flexible guard is spaced apart from an upper edge of the rigid guard by at least 70 mm.

20. The exercise machine of claim 15, wherein the channel is defined by a first surface of the rigid guard, a second surface of the rigid guard, the flexible guard, and the movable belt.

* * * * *